US009387573B2

(12) United States Patent
Pearson

(10) Patent No.: US 9,387,573 B2
(45) Date of Patent: Jul. 12, 2016

(54) SYMMETRICAL OVERLAPPING JAW FRONT ACTION SEALING TOOL

(71) Applicant: Illinois Tool Works Inc., Glenview, IL (US)

(72) Inventor: Daniel R. Pearson, Ingleside, IL (US)

(73) Assignee: Signode Industrial Group LLC, Glenview, IL (US)

( * ) Notice: Subject to any disclaimer, the term of this patent is extended or adjusted under 35 U.S.C. 154(b) by 377 days.

(21) Appl. No.: 13/892,854

(22) Filed: May 13, 2013

(65) Prior Publication Data

US 2013/0327117 A1 Dec. 12, 2013

Related U.S. Application Data

(60) Provisional application No. 61/656,580, filed on Jun. 7, 2012.

(51) Int. Cl.

| | |
|---|---|
| ***B25B 7/20*** | (2006.01) |
| ***B21F 9/02*** | (2006.01) |
| ***B65B 13/02*** | (2006.01) |
| ***B25B 27/14*** | (2006.01) |

(52) U.S. Cl.

CPC ... *B25B 7/20* (2013.01); *B21F 9/02* (2013.01); *B25B 27/146* (2013.01); *B65B 13/025* (2013.01)

(58) Field of Classification Search

CPC ..... B21F 9/02; B25B 7/20; B25B 7/22; B25B 27/146; B65B 13/025; B65B 13/305; B65B 13/345

See application file for complete search history.

(56) References Cited

U.S. PATENT DOCUMENTS 1,784,213 A * 12/1930 Westphal ..... B65B 13/345 140/153

2,035,686 A 3/1936 Briegel (Continued)

OTHER PUBLICATIONS

Midwest Industrial Packaging 2009 Plastic Packaging Tools Products List downloaded from web site Apr. 3, 2012: http://www.miptools.com/Products/PlasticPackagingTools/tabid/823/Default.aspx.

(Continued)

*Primary Examiner* — Edward Tolan

(74) *Attorney, Agent, or Firm* — Levenfeld Pearlstein, LLC

(57) ABSTRACT

A crimping tool for applying a deformable crimp seal onto overlapping layers of strap material includes a head and pairs of jaws disposed in the tool head and operably mounted thereto. Each pair includes opposingly oriented jaw elements. A shear extends between and is operably connected to the jaw elements. The jaw elements have an inwardly oriented crimping portion with a tip having a tapered portion terminating at a free end. A pair of handles are operably connected to the jaw elements and to one another. A side plate is operably connected to the jaw elements and shears and includes a centrally disposed slotted opening. When the tool is in a closed position the jaw elements of each pair align with one another and the free ends of the opposingly oriented jaw element tips overlap in a direction transverse to the jaw elements.

11 Claims, 6 Drawing Sheets

(56) References Cited

U.S. PATENT DOCUMENTS

| | | | | | |
|---|---|---|---|---|---|
| 3,345,856 | A | | 10/1967 | Myers | |
| 4,048,839 | A | | 9/1977 | Peterpaul | |
| 4,480,460 | A | | 11/1984 | Bush et al. | |
| 4,877,228 | A | * | 10/1989 | Ripert | H01R 43/28 269/156 |
| 5,307,664 | A | | 5/1994 | Homm | |
| 6,152,188 | A | * | 11/2000 | Barlasov | B65B 13/345 140/153 |
| 7,121,307 | B2 | * | 10/2006 | Nasiatka | B65B 13/345 140/153 |
| 8,522,830 | B2 | * | 9/2013 | Barlasov | B25B 27/146 140/153 |
| 2004/0262586 | A1 | * | 12/2004 | Moscone | B25C 11/02 254/28 |
| 2011/0219845 | A1 | | 9/2011 | Schurder | |

OTHER PUBLICATIONS

Midwest Industrial Packaging 2009 Steel Packaging Tools Products List downloaded from web site Apr. 3, 2012: http://www.miptools.com/Products/SteelPackagingTools/tabid/822/Default.aspx.

Signode 2010 Products Catalog (Manual Sealers for Steel Strapping) p. 8.

Signode 2010 Products Catalog (Manual Tensioners and Sealers for Plastic Strapping) p. 19.

* cited by examiner

SYMMETRICAL OVERLAPPING JAW FRONT ACTION SEALING TOOL

BACKGROUND

Strapping material is used in a wide variety of applications to secure or bundle loads. The strap material is typically metal or plastic and can be applied to the load using either a manual sealer or a powered sealer. Powered sealers can be pneumatic or electric and can be hand-held or machine-frame type machines. Non-powered (manual) sealers are typically hand-held or hand-operated tools.

The seals (for both metal and plastic strap) can be of the seal-less type or of the crimp seal type. In a seal-less seal or joint, the material is welded to itself (if plastic) or mechanically joined as by locking cuts and projections. Crimp seals, on the other hand, use a band that is bent or wrapped around overlapping portions of strap and mechanically crimped onto the strap. In such a joint, the seal is compressed onto the strap material and the strap material is deformed so as to be secured in the seal.

There are two principal types of seals that are configured based upon the size or width of the strap on which the seal is positioned. For both ½ and ⅝ inch strap, the seals are formed with a base portion and upstanding legs. A top portion of the seal extends from one of the legs, inwardly, forming an asymmetrical design. The legs are commonly referred to as a long leg (the leg that has the top portion of the seal extending therefrom) and a short leg (that leg that is only the upstanding side portion). For ¾ inch strap, the seal is symmetrical. That is, the top portion of the seal is formed from inwardly extending portions of both legs.

In many such seals, the seal is cut, at least in part and is urged into the material to create an interference type of fit. In this manner, portions of the strap and portions of the seal are forced from their respective bodies, into the other material. That is, the strap and seal are cut and bent into each other so that the materials are not only held by compression, but also by interference of the crimp seal with the strap "pulling" from the seal.

Known tools that are used to crimp the seal onto the strap are leverage-type (or lever-action) tools that include a pair of handles that are linked to jaws that pivot inwardly to compress the seal. The seal is held between the jaws and rests on an anvil surface of a shear. In such known tools, a set of jaws and shears are stacked to increase the area over which compression of the seal occurs and the number of locations at which the seal is crimped.

Current jaws may not fully capture the long leg of the seal resulting in an incorrect seal formation. With an incorrect seal formed, the user would then need to install a completely new seal to the strap. This additional installation results in an increase in the amount of time needed to band a load as well as added expense. There is also the possibility that the incorrect seal formation would go unnoticed which could result in the joint in the banding failing at a later point in time.

In tools where the jaws may overlap they tend to have jaws that are longer, but are not in-line with each other. The notchers are bent to allow the jaws to overlap. In this configuration the jaw also overlaps the anvil surface of the notcher. This design has several drawbacks. One drawback is that this overlap significantly increases the force a user must apply to operate the tool properly and crimp the seal. A second drawback that is attributable to the bent notcher design, is that this now requires two different shorter jaws to fill in space in the tool.

Other tools are not symmetrical and instead have a different set of jaws on each side of the tool, one long set and one shorter set. This configuration requires the user to pay close attention to the position of the seal with respect to the tool before crimping to make certain that they are both facing in the proper direction with respect to each other and with respect to the seal.

Accordingly, there is a need for a front action seal tool with symmetrical overlapping in-line jaws for use with strap material. Desirably such a tool is used to easily and quickly form a high reliability seal on overlapping strap material with less force and more reliability than tools already in use. Such a tool can be used with seals of different sizes, without having to change the jaw elements and can be used with a seal at any position within the tool.

SUMMARY

Various embodiments of the present disclosure provide a crimping tool for applying or installing a deformable crimp seal onto overlapping layers of strap material which includes a tool head, pairs of jaws disposed in the tool head, a shear positioned between jaw elements, a pair of handles for actuating the jaws and a side plate.

The jaws are provided in complementary pairs disposed in the tool head and operably mounted thereto. Each pair includes opposingly oriented jaw elements. Each pair of elements is spaced from its adjacent pair of jaw elements.

The jaw elements have an inwardly oriented crimping portion with a tip. The tip has a tapered portion that terminates at a free end. In one embodiment, the jaw elements are identical. The tapered portion has a width that is less than a width of the body of the jaw element.

A shear extends between and operably connects the jaw elements of each pair, and is positioned between adjacent pairs of jaw elements. In an exemplary embodiment having four pairs of jaw elements, three shears are included, one shear between each adjacent pair of jaw elements. The shears include a receiving region in which the deformable crimp seal can be positioned.

The tool includes a pair of handles. The handles have a terminal end operably connected to the jaw elements and operably connected to one another. A side plate is operably connected to the jaw elements and the shears. The side plate includes a centrally disposed slotted opening, When the tool is in a closed position the jaw elements of each pair align with one another and the free ends of the opposingly oriented jaw elements overlap in a direction transverse to the jaw elements.

The tool can include stops disposed to prevent over rotation of the handles in the open position. The stops can be formed as pins disposed in the shears.

In one tool, a connecting plate is included that has two openings. The first opening is configured for receipt of a handle pin and aligns with one of a handle first openings and a respective jaw element lower opening, and a second opening is configured for receipt of a link pin and aligns with a respective handle pivot opening and the side plate slotted opening.

In another embodiment, the crimping tool includes a tool head and a pair of opposing jaw elements operably mounted in the head. Each jaw element includes an upper pivot opening and a lower pivot opening. The jaw elements have an inwardly oriented crimping portion with a tip having a tapered portion and terminating at a free end.

A shear extends between and is operably connected to the jaw elements of each pair and is positioned between adjacent pairs of jaw elements. The jaw elements pivot about respective pins extending through the shear and the jaw elements.

A pair of handles have a terminal end operably connected to the jaw elements and to one another. The handles each have a pivot opening. The tool includes at least one and preferably two side plates for securing the jaw elements, shear and handles to one another. The side plates include a slotted opening and a pin extends through the side plate slotted openings and through the handle pivot openings.

When the tool is in a closed position the jaw elements of each pair align with one another and the free ends of the opposingly oriented jaw element tips overlap in a direction transverse to the jaw elements.

Stops can be disposed in the tool head to prevent over rotation of the handles in the open position.

A jaw element for the crimping tool includes a body having a pair of openings aligned generally longitudinally along the body and a projecting crimping portion. The crimping portion extends generally away from the body and has a beak-like shape defining a free end. The body has a thickness.

The crimping portion has an inwardly angled tapered region terminating at the free end. The inwardly angled tapered region has a thickness that is less than a thickness of the body. The jaw element has first and second surfaces that define the thickness. In one embodiment, the inwardly angled tapered region is formed in the first surface only, such that the second surface is flat.

These and other features and advantages of the present disclosure will be apparent from the following detailed description, in conjunction with the appended claims.

DETAILED DESCRIPTION

Figure 1A:
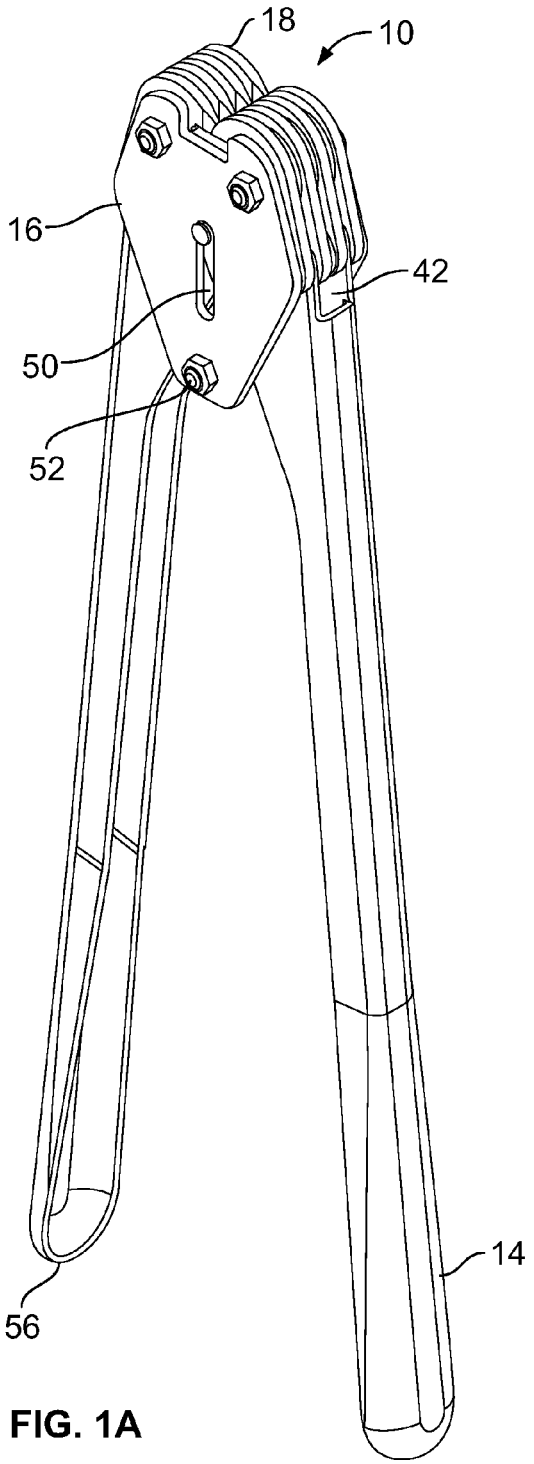
FIGS. 1A and 1B are perspective and enlarged, partial perspective views, respectively, of a symmetrical, overlapping front action sealing tool.

While the disclosed apparatus is susceptible of embodiment in various forms, there is shown in the drawings and will hereinafter be described exemplary embodiments with the understanding that the present disclosure is to be considered an exemplification of the apparatus and is not intended to be limited to the exemplary embodiments illustrated.

Figure 1B:
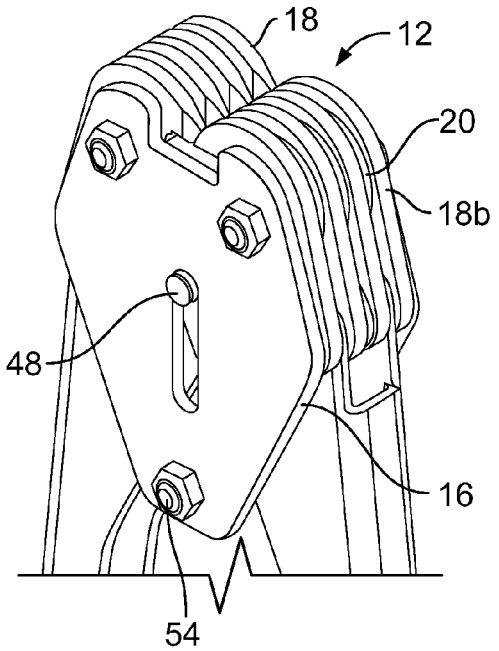

Referring now to the figures and in particular to FIGS. 1A and 1B, there is shown a symmetrical overlapping jaw front action sealing tool 10. The tool 10 includes a head 12, a pair of handles 14, a pair of side plates 16, multiple jaw elements 18, and multiple shear elements or shears 20. An exemplary front action sealing tool is disclosed in Schurder, U.S. patent application Ser. No. 13/028,634 which is commonly assigned with the present application, the disclosure of which is incorporated herein by reference.

Figure 2A:
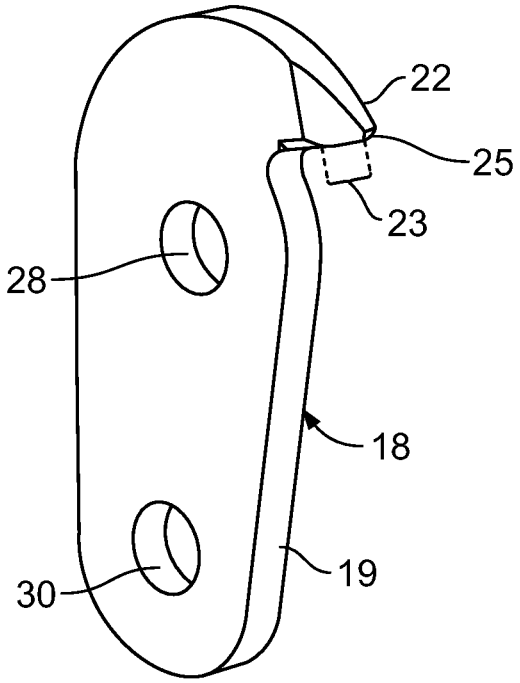
FIG. 2A is a front partial view of an embodiment of the jaw element of the front action sealing tool.
Figure 2B:
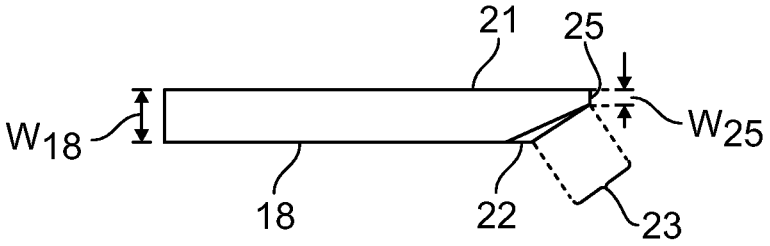
FIG. 2B is a top view of an embodiment of the jaw element of the front action sealing tool.
Figure 5:
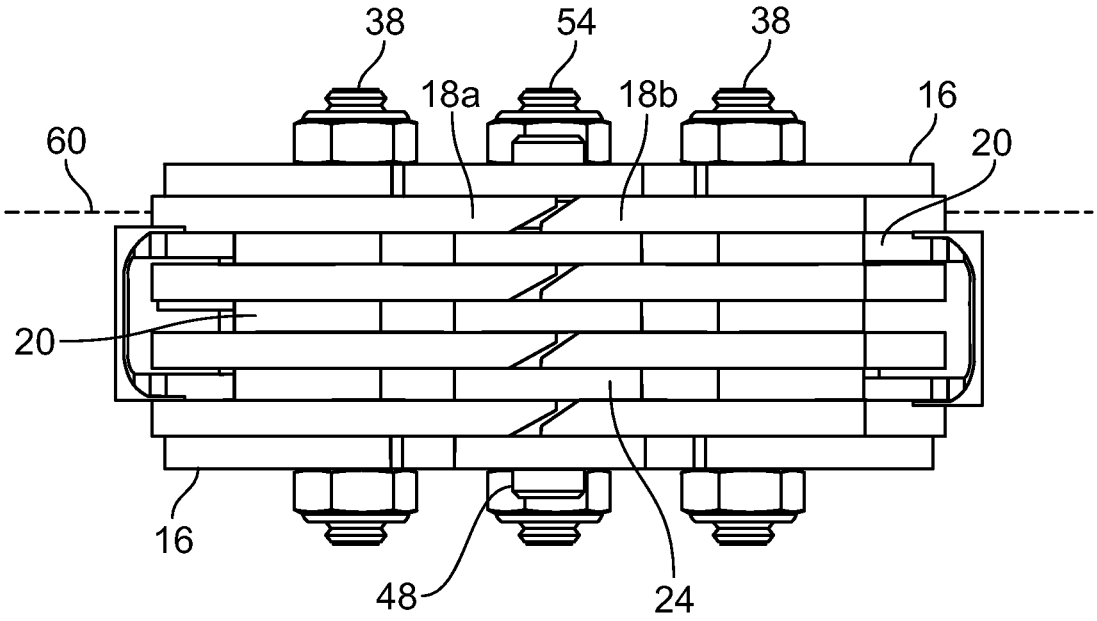
FIG. 5 is a top view of the tool shown in a closed position.

As shown in FIGS. 2A and 2B each jaw element 18 includes a body 19 and a projecting crimping tip 22. The tip 22 extends generally away from the body and has a beak-like shape. The tip 22 has an inwardly angled tapered end portion 23 that terminates at a free end 25. The free end 25 has a width $w_{25}$ (or thickness) that is less than the width $w_{18}$ (or thickness) of the jaw element 18 as it tapers toward the end 25. In one embodiment, the tip 22 tapers toward the end 25 and tapers inwardly (across the width) from one side or surface of the element 18 only. As best seen in FIGS. 2B and 5, one side 21 is straight while the opposite side tapers (as indicated at 23) toward the straight side, toward the end 25 of the element 18 to define the tip 22.

Figure 3:
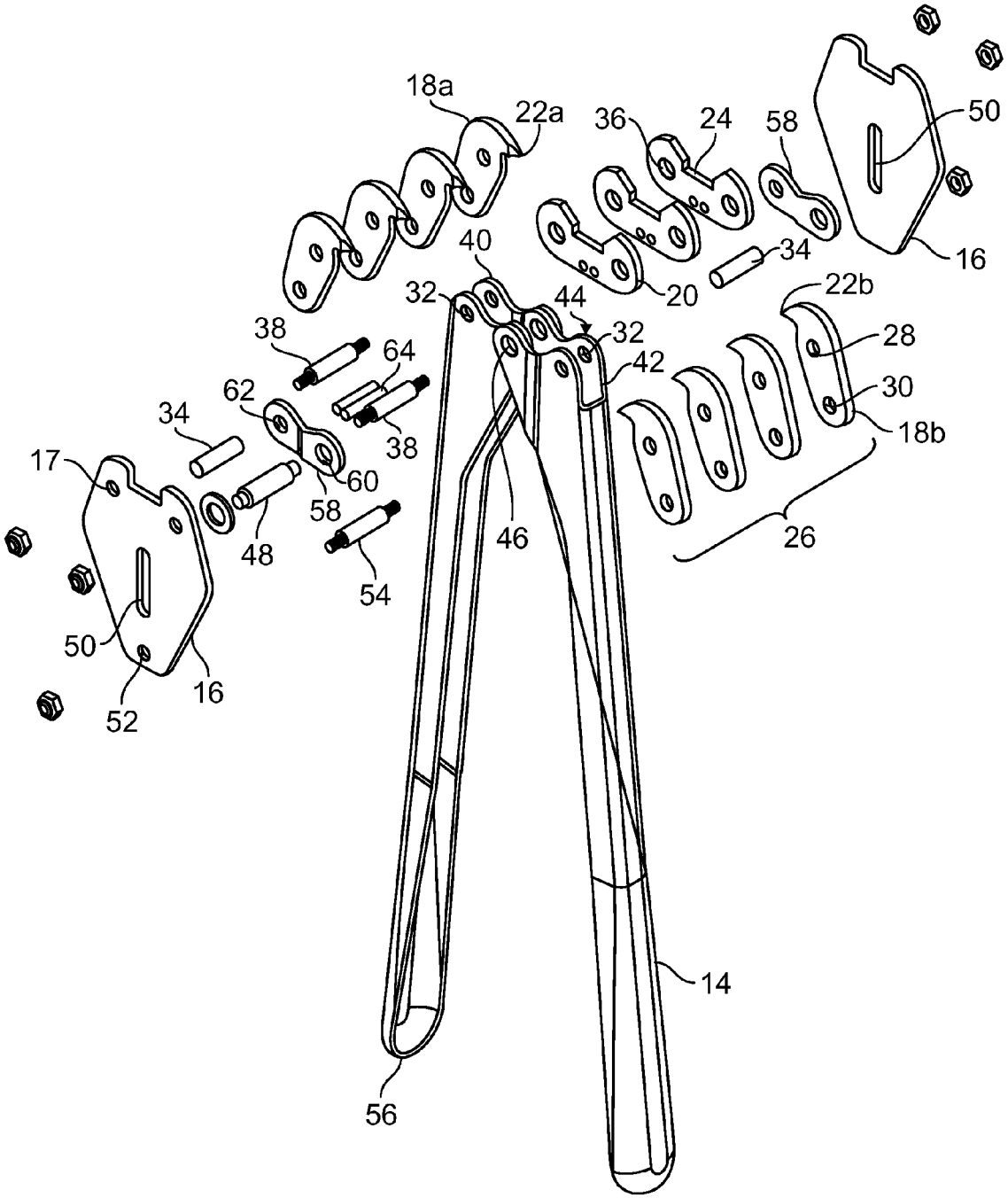
FIG. 3 is an exploded view of the tool.

As shown in FIGS. 3 and 5, the jaw elements 18 are provided in pairs. Accordingly, each jaw element 18*a* has an opposingly oriented jaw element 18*b* such that the tapered portion 23 in the tip 22*a* is facing the tapered portion 23 in the opposingly oriented tip 22*b*. In this manner each jaw element 18*a* and its complement 18*b* are positioned in-line with one another such that the tips 22*a* and 22*b* at their respective free ends 25*a* and 25*b* overlap.

The shears 20 each include an anvil portion 24 on which the base of the seal S rests as the crimping portions overlap. The jaws 18 and shears 20 are stacked on one another to form a unified assembly 26. The jaws 18 have upper openings 28 and lower pivot openings 30. The lower pivot openings 30 align with the openings 32 in the handles and are connected to the handles 14 by handle pins 34. The upper and power pivot openings 28, 30 are generally aligned longitudinally along the body 19 of the jaw element 18.

The upper openings 28 align with openings in the shears 36 and are connected to the shears by link pins 38. The upper openings 28 and shear openings 36 also align with openings 17 in the side plates 16 through which the link pins 38 also insert. The illustrated tool 10 includes four pairs of jaw elements 18 (four jaws) and three shears 20.

The handle ends 40, at the head 12, are bifurcated as indicated at 42. In this manner, the ends 40 capture the jaw/shear assembly 26 between the bifurcations 42 and between the handles 14. The terminal ends 44 of the handles 14 have a pivot opening 46 at which the handles 14 are pinned (by a pivot pin 48) to one another. The pivot pin 48 also traverses through a slotted opening 50 in each of the side plates 16. A lower most opening 52 in each side plate 16 receives a pin 54 that secures the plates 16 to one another which, along with the link pins 38, maintains the head 12 in a fastened (bolted) assembly. The free ends 56 of the handles 14 are configured for a user to grip to use the tool 10.

Connecting plates 58 are positioned within the head 12 between the side plate 16 and the outermost jaw element 18. The connecting plates 58 each have a pair of openings 60, 62. The pivot pin 48 is positioned through one of the openings 60 and the handle pin 34 is positioned through the other opening 62.

A pair of stops 64 can mounted in the head 12 to provide an interference to prevent over rotation of the handles 14 into the open position. It has been found that if the handles 14 are over-rotated, the tool 10 can lock into the open position. It will be appreciated that this can result in an unwanted condition in which the tool 10 is difficult to close toward the crimping or sealing position, and undue manipulation of the tool 10 may be required to position the handles 14 for use. In the illustrated tool 10, the stops 64 are formed as pins that are positioned in the shears 20. The pins 64 provide a physical stop to handle over-rotation. Other ways in which to provide the interference or stop feature can be physical protuberances on the shears 20 or the like, which other features are within the scope and spirit of the present disclosure.

Figure 4:
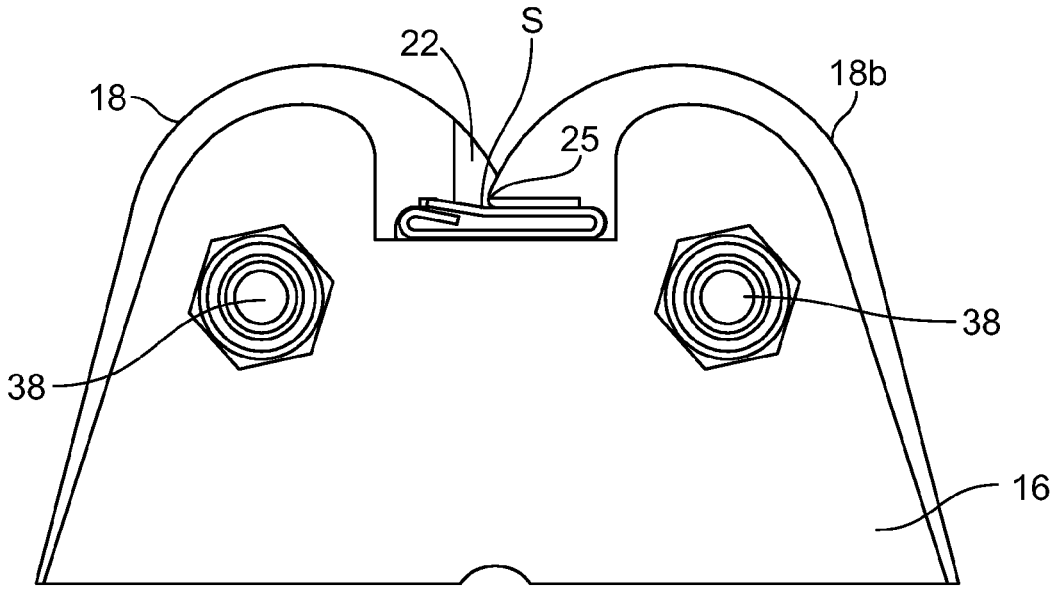
FIG. 4 is a partial front view of an embodiment of a front action sealing tool shown with a crimped seal.

When the tool 10 is in use, the seal S is positioned on the shears 20 and the strap is positioned in the seal S. When the handles 14 are pivoted toward one another, as shown in FIG. 4, the jaws 18 pivot inward and downward onto the seal S (to the closed position). As the jaws 18 are brought inward and downward, the crimping portions, or free end 25*a* of tip 22*a* and the free end 25*b* of tip 22*b* overlap while the jaws 18*a* and 18*b* remain in-line with each other as indicated at 60. As the user continues applying a force, the legs of the seal S are pressed inward and are crimped downward and the seal S is formed. With the inward pivoting of the handles 14, the pivot pin 48 moves upward in the slotted opening 50 (not shown). It will be appreciated by those skilled in the art that the seal S is of a deformable material, such as metal.

With the jaws 18 in-line with their respective complement, there is no skew of the tips 22*a* and 22*b* with the shear anvil surface 24. This significantly reduces the force needed to crimp a seal S and to assure that the seal is straight and uniform, and reduces the twist or torque on the tool.

Figure 6A:
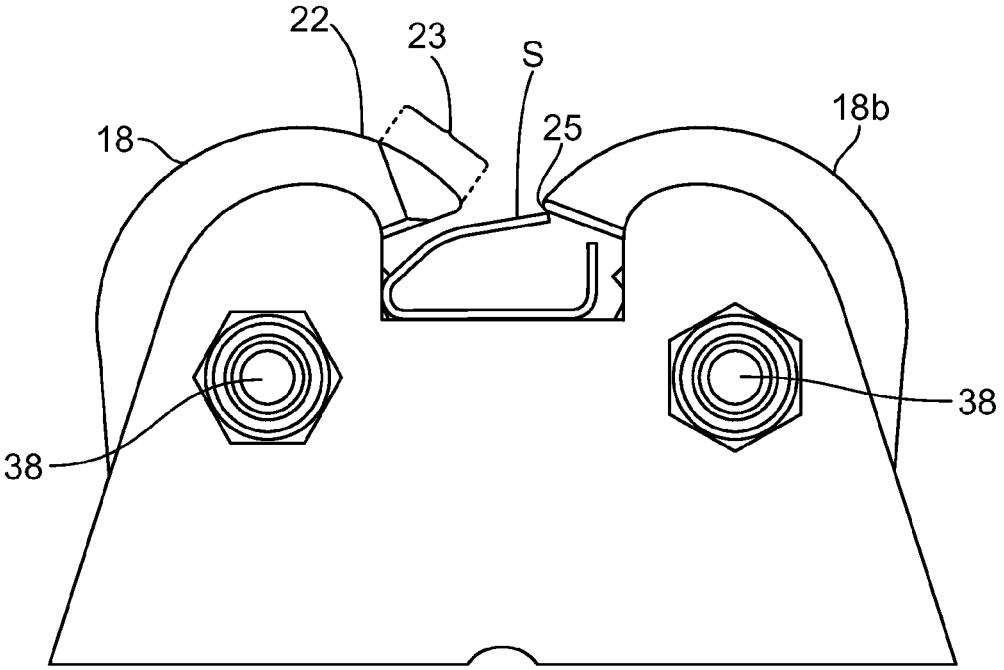
FIGS. 6A and 6B are enlarged views of the symmetrical overlapping jaw tool with a seal positioned in alternative positions.
Figure 6B:
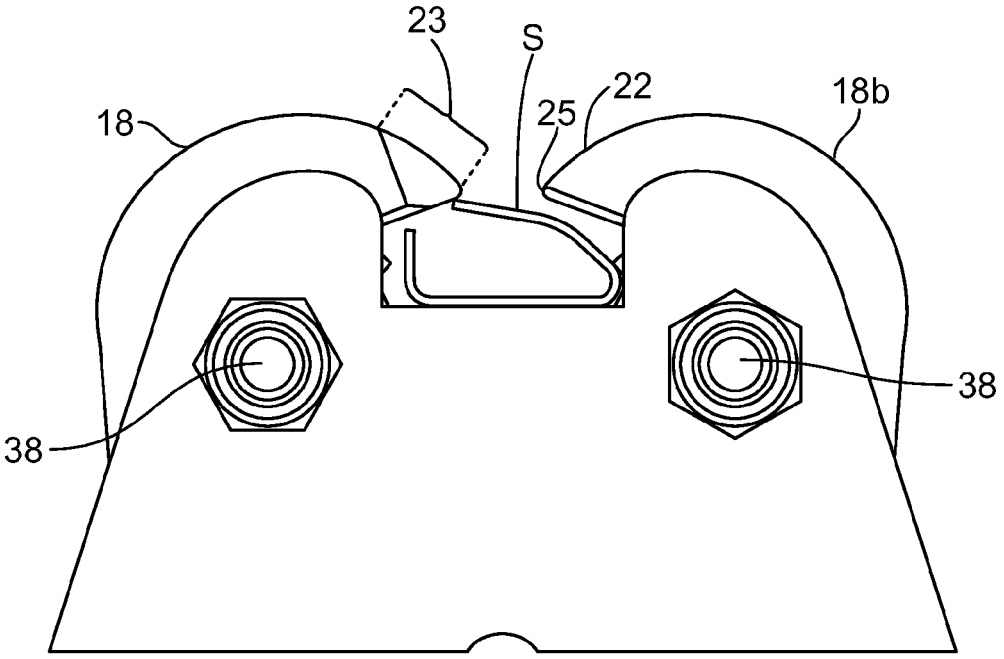

As shown in FIGS. 6A and 6B, the jaw tips 22 are symmetrical and extend toward one another a greater distance than known tools which allows the tips 22 to overlap and allows the seal S to be positioned in the shear in either orientation. This configuration eliminates the need for the user to make certain that the position of the seal within the jaws is in any particular orientation before applying force and crimping the seal.

FIGS. 7A and 7B illustrate another embodiment of the symmetrical overlapping jaw front action sealing tool 110. In this embodiment, the shear anvil portions 124 are shortened (as indicated at 127) to accommodate and properly position a smaller size seal $S_2$. As such, the same tool 10, 110 can be used with different size seals S, $S_2$ by changing out only the shears 20, 120. For example, the same tool 10, 110 can be used to form crimp seals using ¾ inch seals and ½ inch seals by changing out the shears 20 to a smaller size shear, 120. In one example, the shear anvil 124 size can be made smaller by extending a wall (as indicated at 129) of the shear 120 inwardly.

This embodiment of the tool 110 is constructed in the same manner as the embodiment 10 illustrated in FIGS. 1-6, namely, the shears 120 each include an anvil portion 124 on which the base of the seal $S_s$ rests as the crimping portions 125*a* and 125*b* overlap. As noted above- the anvil potion 124 is shortened, as by wall 129, so that a smaller size seal $S_2$ can be used with the tool 110 and will properly seat on and be held within the anvil 124. In this manner, the tool 10, 110, with a change-out of only the anvils 20, 120, can be used for different size seals S, $S_2$. The jaws 118 and shears 120 are stacked on one another to form a unified assembly (not shown).

This embodiment of the tool 110 functions in the same manner as the tool 10 of embodiments FIGS. 1-6. In use, the seal $S_2$ is positioned on the shears 120 and the strap is positioned in the seal $S_2$. When the handles are pivoted toward one another, the jaws 118*a* and 118*b* pivot inward and downward onto the seal $S_2$ (to the closed position). As the jaws 118 are brought inward and downward, the free end 125*a* of tip 122*a* and the free end 125*b* of tip 122*b* overlap while the jaws 118*a* and 118*b* remain in-line with each other. As the user continues applying a force, the legs of the seal $S_2$ are pressed inward and are crimped downward and the seal $S_2$ is formed.

With the jaws 118 in-line with their respective complement, there is no skew of the tips 122*a* and 122*b* with the shear anvil surface 124. This significantly reduces the force needed to crimp a seal $S_2$ and to assure that the seal is straight and uniform, and reduces the twist or torque on the tool.

Again, as shown in FIGS. 7A and 7B, the jaw tips 122 are symmetrical and extend toward one another a greater distance than known tools which allows the tips 122 to overlap and allows the seal $S_2$ to be positioned in the shear 120 in either orientation. This configuration eliminates the need for the user to make certain that the position of the seal $S_2$ within the jaws is in any particular orientation before applying force and crimping the seal.

All patents referred to herein, are hereby incorporated herein by reference, whether or not specifically done so within the text of this disclosure.

In the disclosure, the words "a" or "an" are to be taken to include both the singular and the plural. Conversely, any reference to plural items shall, where appropriate, include the singular.

From the foregoing it will be observed that numerous modification and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

The invention claimed is:

1. A crimping tool for applying a deformable crimp seal onto overlapping layers of strap material, comprising:

a tool head;

pairs of jaws disposed in the tool head and operably mounted thereto, each pair including opposingly oriented, aligned jaw elements, each jaw element of each pair being spaced from one another, and each pair being spaced from its adjacent pair, each jaw element having an inwardly oriented crimping portion with an asymmetric tip, the asymmetric tip having a tapered portion, the tapered portion terminating at a free end;

a shear extending between and operably connected to each element of each pair and between adjacent pairs of jaw elements;

a pair of handles, the handles having a terminal end operably connected to the jaw elements and operably connected to one another; and at least one side plate operably connected to the jaw elements and the shear, the at least one side plate including a centrally disposed slotted opening, wherein when the tool is in a closed position the jaw elements of each pair align with one another and the free ends of the opposingly oriented jaw element tips overlap in a direction transverse to the jaw elements, and wherein each jaw element has first and second surfaces defining a thickness and wherein the inwardly angled tapered region is formed in the first surface only, such that the second surface is flat, and wherein the inwardly angled tapered regions of opposing aw elements face one another.

2. The crimping tool of claim 1 wherein each jaw element is identical to each other jaw element.

3. The crimping tool of claim 1 including at least three pairs of jaws and two shears.

4. The crimping tool of claim 1 including a shear positioned between each of the pairs of jaw elements.

5. The crimping tool of claim 1 wherein the tapered portion has a width that is less than a width of the jaw.

6. The crimping tool of claim 1 including stops disposed to prevent over rotation of the handles in an open position.

7. The crimping tool of claim 6 wherein the stops are pins disposed in the shears.

8. The crimping tool of claim 1 including a connecting plate having two openings therein, a first opening for receipt of a handle pin and aligning with one of a handle first openings and a respective jaw element lower opening and a second opening for receipt of a link pin and aligning with a respective handle pivot opening and the side plate slotted opening.

9. The crimping tool of claim 1 wherein the shear includes a receiving region in which the deformable crimp seal can be positioned.

10. A crimping tool for applying a deformable crimp seal onto overlapping layers of strap material, comprising:

a tool head;

a pair of opposingly oriented jaw elements operably mounted in the head, each jaw element including an upper pivot opening and a lower pivot opening, each jaw element having an inwardly oriented crimping portion with a tip having an asymmetric tapered portion and terminating at a free end, the asymmetric tapered portion defined by a first straight surface and a second angled surface, the angled surfaces of the pair of opposingly oriented jaw elements facing one another;

a shear extending between and operably connected to the jaw elements, the jaw elements pivoting about respective pins extending through the shear and the jaw elements;

a pair of handles, the handles each having a terminal end operably connected to the jaw elements and to one another, the handles each having a pivot opening;

at least one side plate for securing the jaw elements, shear and handles to one another, the side plate including a slotted opening;

a pin extending through the side plate slotted opening and through handle pivot openings, wherein when the tool is in a closed position the opposingly oriented jaw elements of each pair align with one another and the free ends of the opposingly oriented jaw element tips overlap in a direction transverse to the jaw elements.

11. The crimping tool of claim 10 including stops disposed to prevent over rotation of the handles in the open position.

* * * * *